US010816930B2

(12) United States Patent
Miwa et al.

(10) Patent No.: US 10,816,930 B2
(45) Date of Patent: Oct. 27, 2020

(54) IMAGE FORMING APPARATUS

(71) Applicant: CANON KABUSHIKI KAISHA, Tokyo (JP)

(72) Inventors: Koji Miwa, Susono (JP); Shoichi Zensai, Yokohama (JP); Tomofumi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/624,096

(22) PCT Filed: Sep. 12, 2018

(86) PCT No.: PCT/JP2018/033821
§ 371 (c)(1),
(2) Date: Dec. 18, 2019

(87) PCT Pub. No.: WO2019/059064
PCT Pub. Date: Mar. 28, 2019

(65) Prior Publication Data

US 2020/0133198 A1 Apr. 30, 2020

(30) Foreign Application Priority Data

Sep. 25, 2017 (JP) ..... 2017-183526

(51) Int. Cl.
*G03G 15/18* (2006.01)
*G03G 21/18* (2006.01)
*G03G 21/16* (2006.01)

(52) U.S. Cl.
CPC ..... *G03G 21/1839* (2013.01); *G03G 21/1633* (2013.01)

(58) Field of Classification Search
CPC ..... G03G 21/1666; G03G 21/1633; G03G 21/1853; G03G 15/04036; G03G 21/1839
See application file for complete search history.

(56) References Cited

U.S. PATENT DOCUMENTS

| | | | | |
|---|---|---|---|---|
| 8,837,982 | B2 | 9/2014 | Matsuda | |
| 2002/0018666 | A1* | 2/2002 | Noda | G03G 15/757 399/90 |
| 2008/0193163 | A1* | 8/2008 | Moon | G03G 21/08 399/128 |
| 2012/0114374 | A1* | 5/2012 | Suzuki | G03G 15/04 399/111 |

FOREIGN PATENT DOCUMENTS

| | | |
|---|---|---|
| JP | 2004-170866 A | 6/2004 |
| JP | 2009-139451 A | 6/2009 |

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

In a configuration in which a cartridge is removably mounted from a longitudinal direction of the cartridge (a side-oriented configuration), an image bearing member is disposed at a position farther from a light emitting unit in a state in which a cover is opened than a state in which the cover is closed in a direction perpendicular to the longitudinal direction of the cartridge.

11 Claims, 11 Drawing Sheets

IMAGE FORMING APPARATUS

TECHNICAL FIELD

The present disclosure relates to image forming apparatuses, such as copying machines, printers, and facsimile machines. In particular, the present disclosure relates to an image forming apparatus whose cover is opened or closed to mount or detach a cartridge.

BACKGROUND ART

In known electrophotographic image forming apparatuses in the art (hereinafter referred to as "image forming apparatus"), a photosensitive drum and a processing unit for the photosensitive drum are integrated into a cartridge. This cartridge can be removably mounted to the main body of the image forming apparatuses (a cartridge system). This cartridge system allows the user to maintain the apparatus without relying on service personnel, thereby enhancing the operability. For that reason, this cartridge system is widely used in image forming apparatuses.

To reduce output cost per page, some recent image forming apparatuses in the market are configured so that a plurality of cartridges are removably mounted to one image forming apparatus to allow maintenance with minimum necessary consumable item replacement. Examples include a drum cartridge, a developing cartridge, and a toner cartridge. The configuration including a plurality of cartridges leads to an increase in the number of units to be replaced. This makes it difficult for the user to distinguish a unit to be replaced. It is important to allow the user to easily distinguish the cartridge to be replaced from the plurality of cartridges.

In known models, the cartridge to be replaced by the user is indicated in combination of a label attached to the apparatus main body or the cartridge and a display on the panel of the image forming apparatus. Other methods for indicating the cartridge to be replaced to enhance the usability are disclosed. PTL 1 discloses an apparatus in which, when a cartridge is brought to a replaceable state after an instruction to replace the cartridge is displayed on a display, an exposure unit in the vicinity of the target cartridge is made luminous. PTL 2 discloses a method for notifying the user by controlling the light emission state of an exposure unit based on individual components in the main body detected by a detection unit.

The apparatus disclosed in PTL 1 notifies the user by making the exposure unit (the light emitting unit) in the vicinity of the cartridge to be replaced emit light after a cartridge replacing instruction is displayed on a display and when the cartridge is brought to a replaceable state. However, with a side-oriented configuration in which the cartridge is removably mounted in the longitudinal direction, the light emitting unit is not exposed to the outside even when the cover is opened so that the cartridge can be replaced, providing low user's visibility. Furthermore, even when light is emitted from the light emitting unit, the light tends to stay in the image forming apparatus because the light emitting unit is not exposed to the outside, making it difficult for the user to recognize the light.

Also with the method disclosed in PTL 2, if the apparatus has the side-oriented configuration as in PTL 1, it is difficult for the user to recognize the light emitted from the light emitting unit.

CITATION LIST

Patent Literature

[PTL 1]
Japanese Patent Laid-Open No. 2004-170866
[PTL 2]
Japanese Patent Laid-Open No. 2009-139451

SUMMARY OF INVENTION

According to a first aspect of the present disclosure, an image forming apparatus capable of holding at least two cartridges, wherein the cartridges can be mounted on or demounted from the image forming apparatus in a longitudinal direction of the cartridges, is provided. The image forming apparatus includes a light emitting unit configured to emit light toward an image bearing member, a control unit configured to control light emission of the light emitting unit, and a cover configured to be opened to mount or demount the cartridge. The image bearing member is disposed at a first position farther from the light emitting unit in a state in which the cover is opened than at a second position in a state in which the cover is closed in a direction perpendicular to a longitudinal direction of the cartridge. The control unit controls the light emission of a light emitting unit closest to a cartridge that is determined to be removed from the image forming apparatus.

According to a second aspect of the present disclosure, an image forming apparatus capable of holding at least two cartridges, wherein the cartridges can be mounted on or demounted from the image forming apparatus in a longitudinal direction of the cartridges, is provided. The image forming apparatus includes a light emitting unit configured to emit light toward an image bearing member, a control unit configured to control light emission of the light emitting unit, and a cover configured to be opened to mount or demount the cartridge. When the cover is opened, the light emitting unit moves toward an opening that is formed when the cover is opened. The control unit controls the light emission of a light emitting unit closest to a cartridge that is determined to be removed from the image forming apparatus.

According to a third aspect of the present disclosure, an image forming apparatus is provided in which a first cartridge including a first image bearing member, a second cartridge including a second image bearing member, a third cartridge that contains toner and is configured to supply toner to the first image bearing member to form a toner image, and a fourth cartridge that contains toner and is configured to supply toner to the second image bearing member to form a toner image are independently removably mounted in a longitudinal direction of each cartridge. The image forming apparatus includes a first light emitting unit configured to emit light toward the first image bearing member, a second light emitting unit configured to emit light toward the second image bearing member, a control unit configured to control light emission of the first flight emitting unit and the second light emitting unit, and a cover configured to be opened to mount or demount the first to four cartridges. The first image bearing member is disposed at a first position farther from the first light emitting unit in a state in which the cover is opened than at a second position in a state in which the cover is closed in a direction perpendicular to a longitudinal direction of the cartridge. The second image bearing member is disposed at a third position farther from the second light emitting unit in a state in which the cover is opened than at a fourth position in a state in which the cover is closed in the direction perpendicular to the longitudinal direction of the cartridge. When the control unit determines that the first cartridge needs to be demounted from the image forming apparatus, the control unit controls light emission so that light is emitted from the first light emitting unit in the state in which the cover is opened.

According to a fourth aspect of the present disclosure, an image forming apparatus is provided in which a first cartridge including a first image bearing member, a second cartridge including a second image bearing member, a third cartridge that contains toner and is configured to supply toner to the first image bearing member to form a toner image, and a fourth cartridge that contains toner and is configured to supply toner to the second image bearing member to form a toner image are independently removably mounted in a longitudinal direction of each cartridge. The image forming apparatus includes a first light emitting unit configured to emit light toward the first image bearing member, a second light emitting unit configured to emit light toward the second image bearing member, a control unit configured to control light emission of the first night emitting unit and the second light emitting unit, and a cover configured to be opened to mount or demount the first to four cartridges. The first image bearing member is disposed at a position farther from the first light emitting unit in a state in which the cover is opened than at a second position in a state in which the cover is closed in a direction perpendicular to a longitudinal direction of the cartridge. The second image bearing member is disposed at a third position farther from the second light emitting unit in a state in which the cover is opened than at a fourth position in a state in which the cover is closed in the direction perpendicular to the longitudinal direction of the cartridge. When the control unit determines that the third cartridge needs to be demounted from the image forming apparatus, the control unit controls light emission so that light is emitted from the first light emitting unit in the state in which the cover is opened.

Further features of the present invention will become apparent from the following description of exemplary embodiments with reference to the attached drawings.

DESCRIPTION OF EMBODIMENTS

Embodiments of the present disclosure will be described in detail with reference to the drawings. However, the dimensions, materials, shapes, and the relative dispositions of the components described in the embodiments should be appropriately changed according to the configuration of the apparatus to which the present disclosure is applied and various conditions. In other words, the scope of the present disclosure is not limited to the following embodiments.

[First Embodiment]

[Overall Configuration of Image Forming Apparatus]

Figure 1:
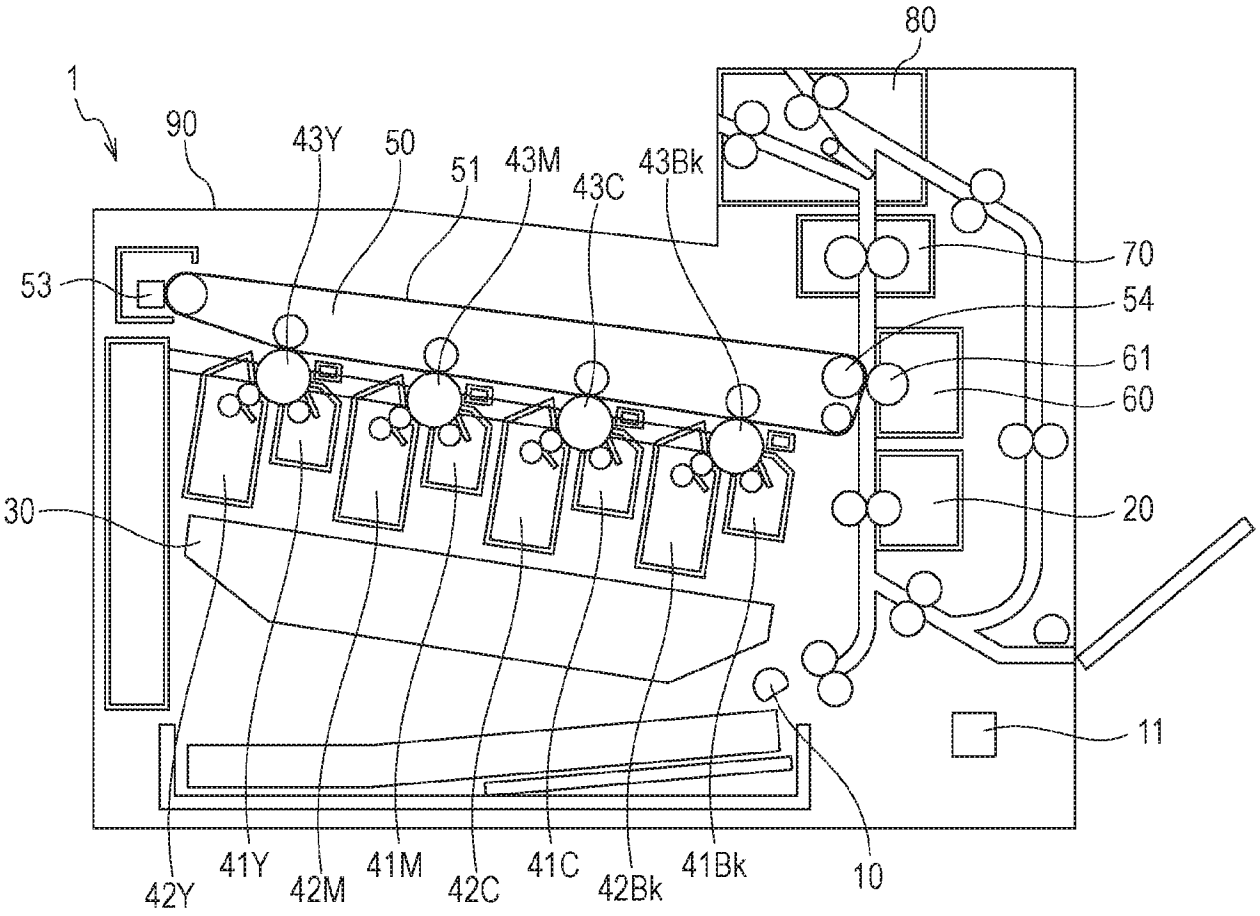
FIG. 1 is a schematic cross-sectional view of an image forming apparatus according to a first embodiment of the present disclosure.

First, the overall configuration of a color electrophotographic image forming apparatus 1 (hereinafter referred to as "image forming apparatus") in which eight cartridges can be held and removably mounted will be described in outline. FIG. 1 is a schematic cross-sectional view of the image forming apparatus 1 illustrating the overall configuration thereof. The image forming apparatus 1 includes a withdrawal sheet feeding unit 10 for feeding contained sheets S (printing materials such as paper) at the bottom. A registration roller unit 20 for adjusting the sheet S and matching the conveyance timing is disposed right above the sheet feeding unit 10. An optical unit 30 which is an exposure unit that emits a laser beam onto photosensitive drums (43Y, 43M, 43C, and 43Bk) based on image information to form electrostatic latent images is disposed above the sheet feeding unit 10. Eight cartridges for forming four color toner images are disposed above the optical unit 30 (the exposure unit). One kind of the cartridges includes drum cartridges (41Y, 41M, 41C, and 41Bk) each including a photosensitive drum 43 which is an image bearing member. Another cartridge includes developing cartridges (42Y, 42M, 42C, and 42Bk) that develop electrostatic latent images for forming a toner image on each of the photosensitive drums 43. A set of the drum cartridge 41 and the developing cartridge 42 forms a toner image of one color. An intermediate transfer unit 50 is disposed above the cartridges 41 and 42 so as to face the cartridges 41 and 42. The toner image on the photosensitive drum 43 is primarily transferred onto an intermediate transfer belt 51 at a primary transfer portion formed of the photosensitive drum 43 of the drum cartridge 41 and a primary transfer roller 52 of the intermediate transfer unit 50. The toner images on the photosensitive drums (43Y, 43M, 43C, and 43Bk) are formed into one image on the intermediate transfer belt 51. An intermediate-transfer-belt cleaning unit 53 for cleaning toner remaining on the intermediate transfer belt 51 is disposed outside the intermediate transfer unit 50. An intermediate-transfer-belt drive roller 54 for conveying the toner image primarily transferred onto the intermediate transfer belt 51 is disposed at the right of the intermediate transfer unit 50. A secondary transfer unit 60 for secondarily transferring the toner image to the sheet S at a secondary transfer portion formed of the intermediate-transfer-belt drive roller 54 and a secondary transfer roller 61 of a secondary transfer unit 60 is disposed. A fixing unit 70 for fixing the toner image to the sheet S using heat and pressure is disposed above the secondary transfer unit 60. The sheet S to which the toner image is fixed is discharged to a sheet supporting unit 90 by a sheet output unit 80 disposed left above the fixing unit 70.

[Configuration of Cartridges and their Peripherals]

Figure 2:
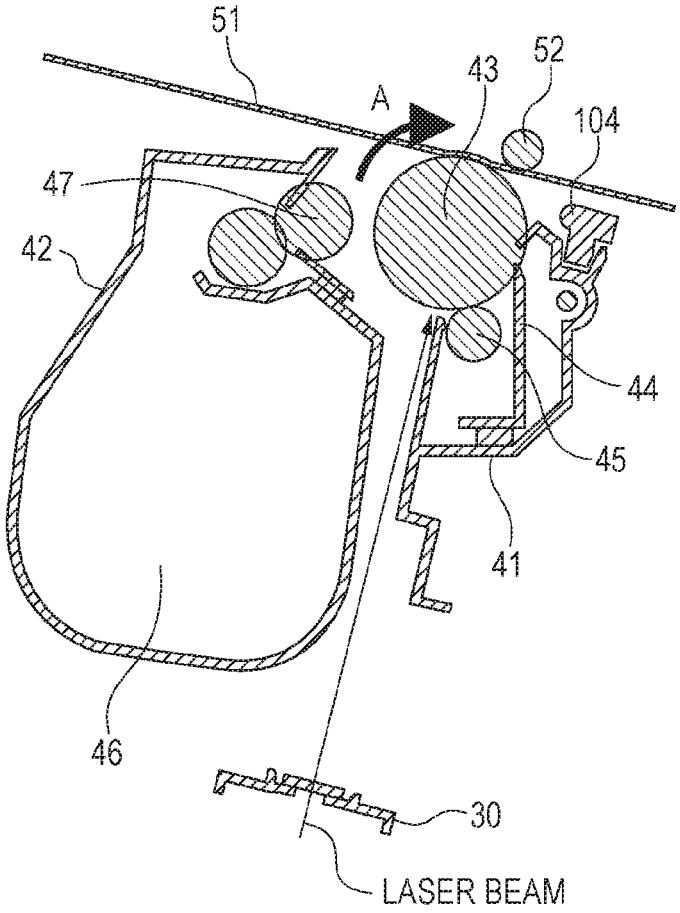
FIG. 2 is a schematic cross-sectional view of cartridges and their peripherals according to the first embodiment illustrating the configuration thereof.

Referring next to FIG. 2, the configuration of the cartridges and their peripherals will be described. The cartridges of the present embodiment include the drum cartridges 41 each including the photosensitive drum 43 (an image bearing member) and the developing cartridges 42 each including a toner container 46 containing toner for developing an electrostatic latent image. The present embodiment includes four sets of the drum cartridge 41 and the developing cartridge 42. The sets have the same structure but differ in that they form toner images of different colors and contain yellow (Y), magenta (M), cyan (C), and black (Bk) toners. Each photosensitive drum 43 (the image bearing member) is rotationally driven in the direction of arrow A in FIG. 2 by a driving unit (not illustrated). A pre-exposure unit 104, a photosensitive-drum cleaning unit 44, a charging roller 45, an optical unit 30, a developing unit 47, and a primary transfer roller 52 are disposed around the photosensitive drum 43 in sequence in the rotating direction. Each component will be described below.

Figure 10:
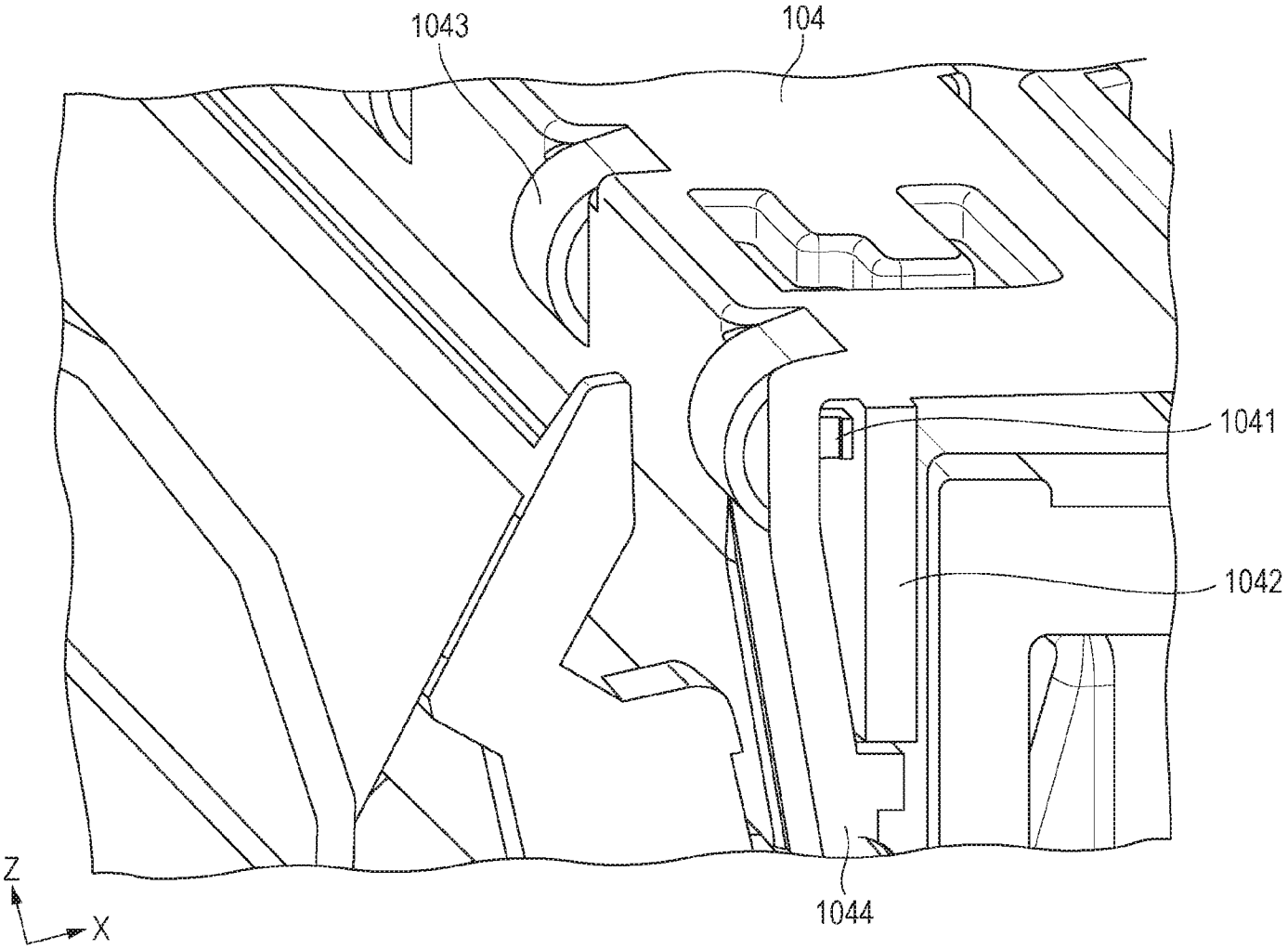
FIG. 10 is a diagram of the light emitting unit illustrating the configuration thereof.
Figure 11:
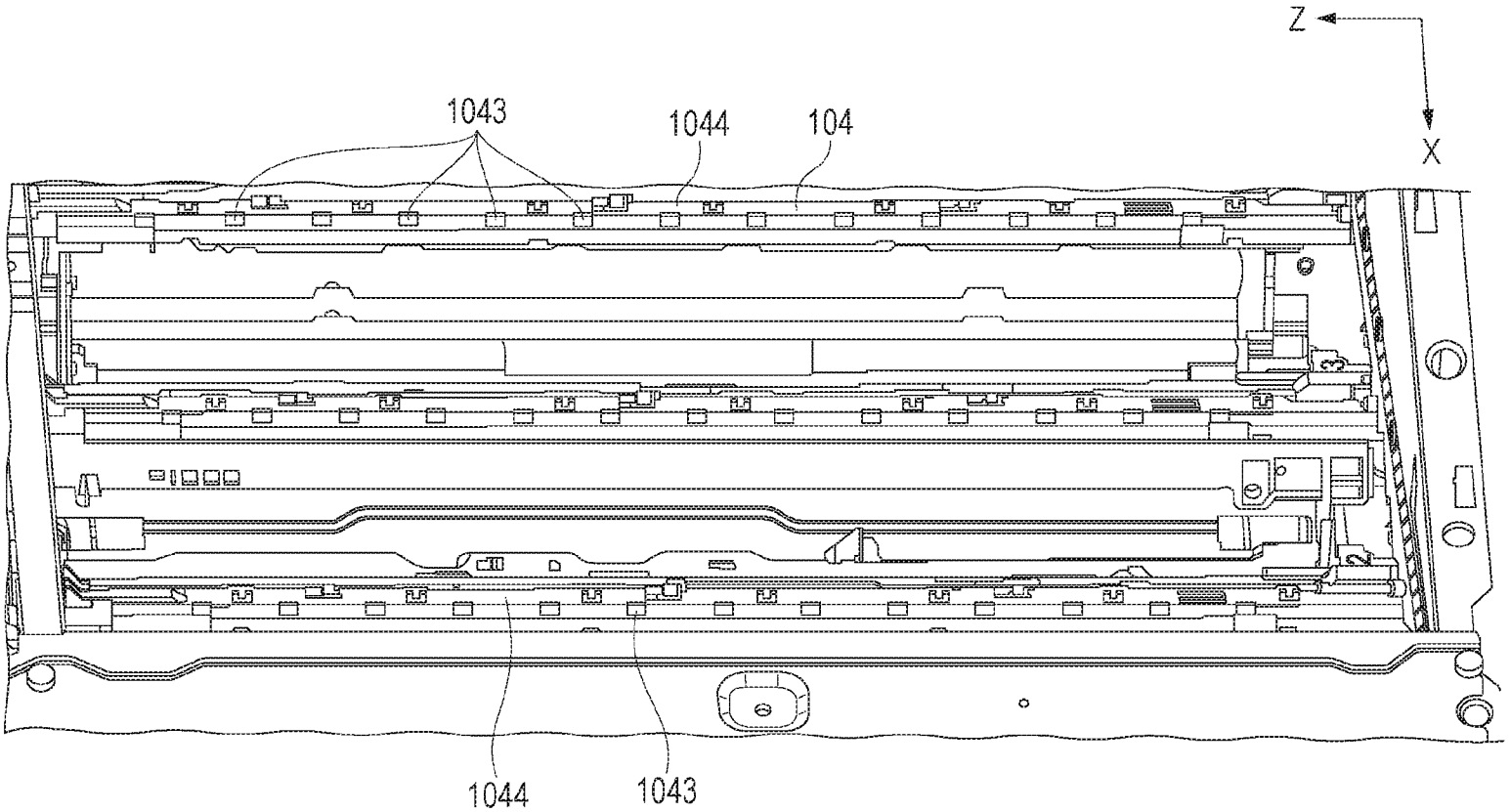
FIG. 11 is a perspective view of the light emitting unit, with cartridges removed from the image forming apparatus.

The pre-exposure unit 104 of the present embodiment emits the light of chip light-emitting diodes (LEDs) disposed at intervals on the longitudinal line of the drum cartridge 41 to the photosensitive drum 43 to decrease the potential on the surface of the photosensitive drum 43 and uniformize the distribution of the potential after primary transfer. In the present embodiment, the pre-exposure unit 104 is used as a light emitting unit. The configuration of the pre-exposure unit 104 will be described with reference to FIGS. 10 and 11. As illustrated in FIG. 10, the pre-exposure unit 104 includes LEDs 1041 serving as light sources, a substrate 1042 that supports the LEDs 1041, lens units 1043 through which the light emitted from the LEDs 1041 passes, and a frame 1044 that supports the lens units 1043. As illustrated in FIG. 11, the lens units 1043 through which the light emitted from the LEDs 1041 passes are disposed at intervals in the longitudinal direction of the drum cartridge 41 or the axial direction of the photosensitive drum 43. In FIG. 11, 13 lens units 1043 are provided in line in the longitudinal direction of the drum cartridge 41. In FIG. 11, the LEDs 1041 serving as light sources (hidden by the lens units 1043 and the frame 1044 supporting the lens units 1043) are disposed on the back of the lens units 1043. Thus, 13 LEDs of one line are disposed at intervals in the longitudinal direction of the drum cartridge 41. In the present embodiment, four lines, 52 LEDs in total, are disposed.

The photosensitive-drum cleaning unit 44 removes primary-transfer residual toner remaining on the surface of the photosensitive drum 43. Secondary-transfer residual toner remaining on the surface of the intermediate transfer belt 51 and charged by the intermediate-transfer-belt cleaning unit 53 and inversely transferred to the photosensitive drum 43 is also removed by the photosensitive-drum cleaning unit 44. The charging roller 45 applies a charging bias voltage with a transformer power source when being in contact with the surface of the photosensitive drum 43 to uniformly charge the surface of the photosensitive drum 43. The photosensitive drum 43, the photosensitive-drum cleaning unit 44, and the charging roller 45 are integrated as the drum cartridge 41.

The optical unit 30 (the exposure unit) is disposed vertically below the drum cartridge 41 and emits a laser beam based on the image information sent from the control unit 11 onto the photosensitive drum 43 to attenuate the potential on the surface of the photosensitive drum 43, thereby forming an electrostatic latent image on the surface of the photosensitive drum 43.

The developing unit 47 applies a developing bias voltage from a developing bias power source (transformer power source) (not illustrated) to cause charged toner (developer) to be attached to the electrostatic latent image formed on the surface of the photosensitive drum 43 to thereby develop it as a toner image (a developer image). The developing unit 47 is integrated with a casing also serving as a toner container 46 into the developing cartridge 42. Although the developing unit 47 of the present embodiment is a developing roller, the developing unit 47 may include a supply roller that supplies toner to the developing roller.

The primary transfer roller 52 performs primary transfer by applying a primary-transfer bias voltage from a bias applying unit (not illustrated) to transfer the toner image on the photosensitive drum 43 to the intermediate transfer belt 51.

[Cartridge Mounting and Demounting Operation]

Figure 3A:
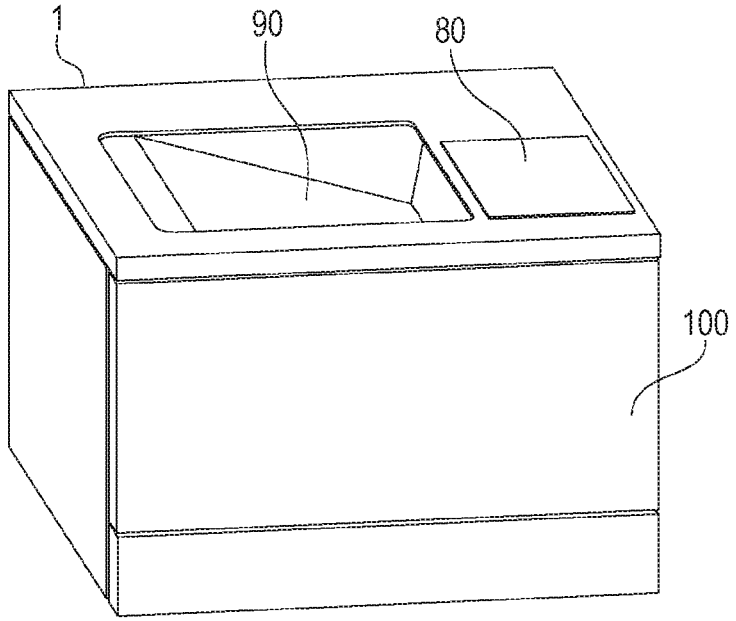
FIG. 3A is a perspective view of the image forming apparatus.
Figure 3B:
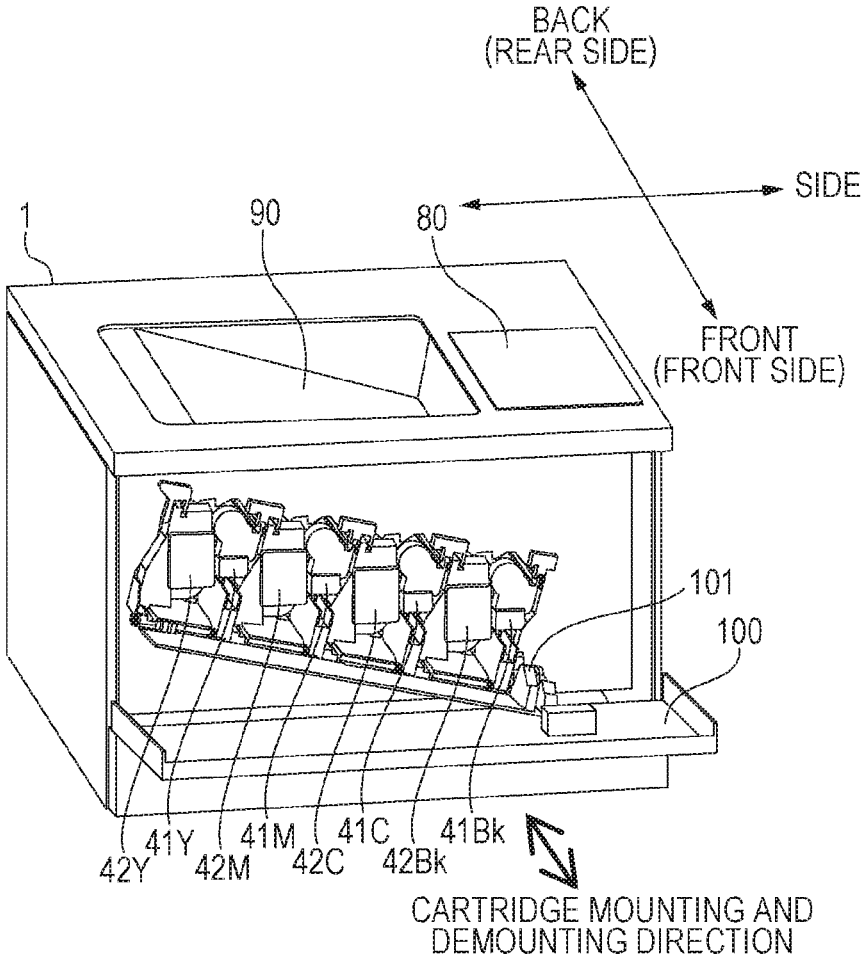
FIG. 3B is a perspective view of the image forming apparatus illustrating a cover opening and closing operation for replacing a cartridge.
Figure 4A:
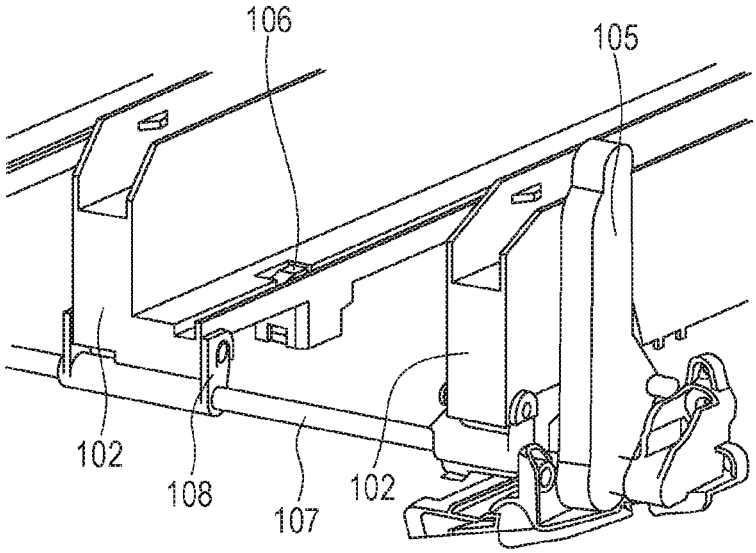
FIG. 4A is a schematic diagram of cartridge peripheral members when a cover is closed according to the first embodiment.
Figure 4B:
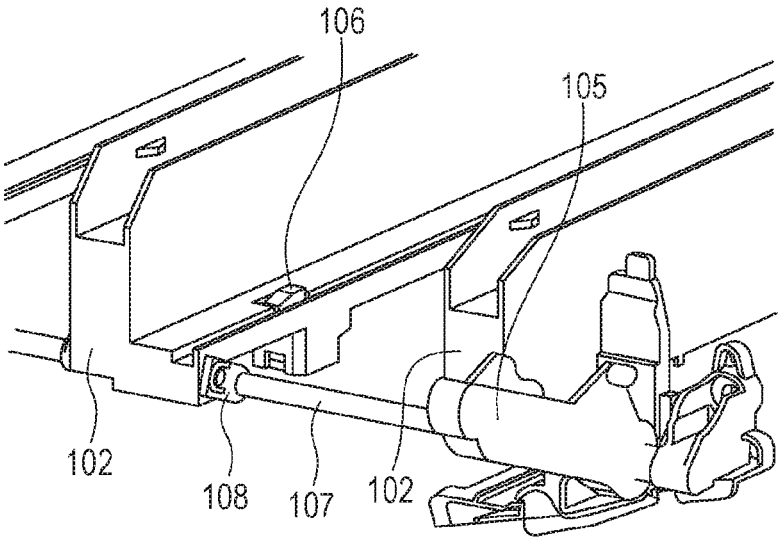
FIG. 4B is a schematic diagram illustrating the motion of the cartridge peripheral members when the cover is opened according to the first embodiment.
Figure 5A:
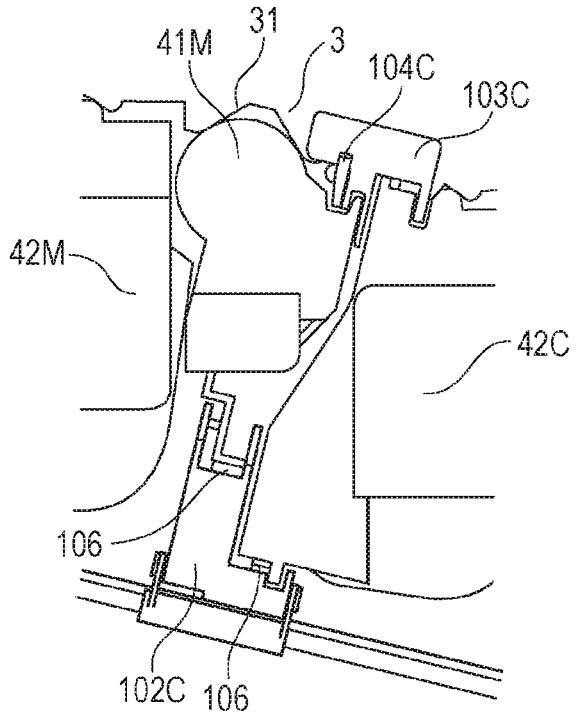
FIG. 5A is a schematic diagram of the cartridge peripheral members when the cover is closed according to the first embodiment.
Figure 5B:
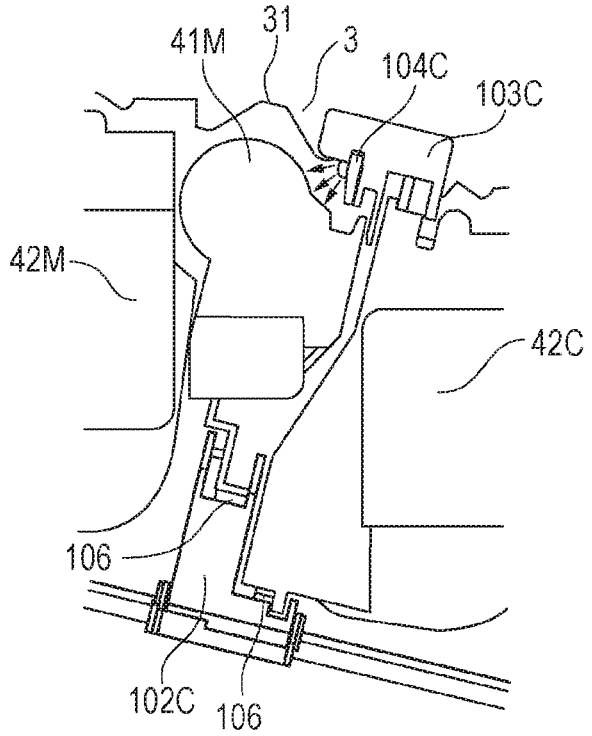
FIG. 5B is a schematic diagram illustrating the motion of the cartridge peripheral members when the cover is opened according to the first embodiment.
Figure 6A:
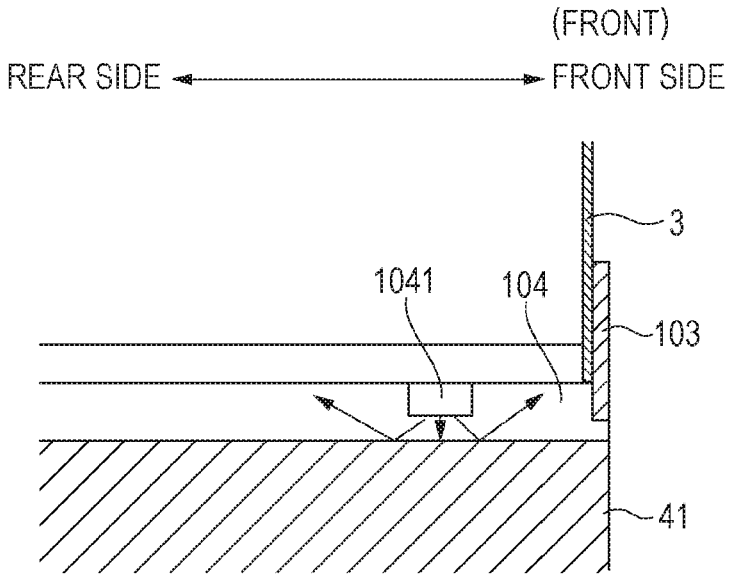
FIG. 6A is a diagram illustrating the state of light emitted from a pre-exposure unit (a light emitting unit) when the cover is closed according to the first embodiment.
Figure 6B:
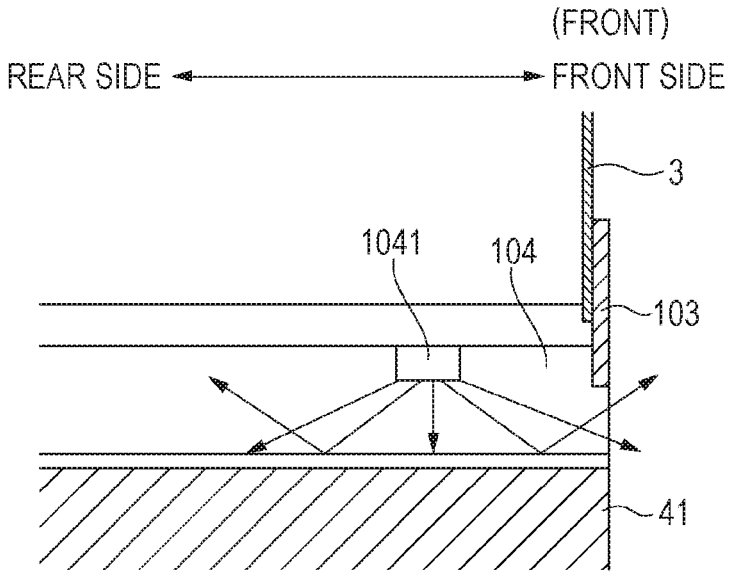
FIG. 6B is a diagram illustrating the state of light emitted from the pre-exposure unit when the cover is opened according to the first embodiment.

FIGS. 3A and 3B are perspective views of the image forming apparatus 1 illustrating the main body in a cartridge replacing operation. The image forming apparatus 1 is configured so that cartridges can be removably mounted in the longitudinal direction of the cartridges (for a drum cartridge, in the axial direction of the photosensitive drum 43) and to the front of the image forming apparatus 1 (a side-oriented configuration). In other words, the cartridges are mounted and demounted by opening and closing a rotatable cover 100 at the front of the image forming apparatus 1. FIGS. 4A and 4B are perspective views of lower guides 102 serving as guides in opening and closing the cover 100 illustrating the motion of the cover 100 and the motion of the cartridge. FIGS. 5A and 5B are front views of the cartridge, an upper guide 103C serving as a guide, the lower guide 102C serving as a guide, and the pre-exposure unit 104C illustrating the positional relationship among them when the cover 100 is opened and closed. FIG. 5A illustrates a state in which the cover 100 is closed, which is a disposition at image formation. FIG. 5B illustrates a state in which the cover 100 is opened, which is a disposition when the cartridge is mounted or demounted. FIGS. 6A and 6B are diagrams illustrating the LED-light travel path of the pre-exposure unit 104 (a light emitting unit) when the cover 100 is opened or closed. FIG. 6A illustrates a state in which the cover 100 is closed, which is a disposition at image formation. FIG. 6B illustrates a state in which the cover 100 is opened, which is a disposition when the cartridge is mounted or demounted.

The upper guide 103 and the lower guide 102 (two guides) serving as guides for inserting or ejecting the cartridge are disposed above and below the cartridges 41 and 42. The upper guide 103 integrated with the pre-exposure unit 104 and fixed to the main body frame is disposed above the cartridge 41. The lower guide 102 which includes a cartridge pressing member 106 and moves as the cover 100 is opened or closed is disposed below the cartridge 42.

Next, a state in which the cover 100 is opened or closed will be described with reference to the drawings. In a state in which the cover 100 is closed (at image formation), the drum cartridge 41 is urged upward in the image forming apparatus 1 by the cartridge pressing member 106 disposed in the lower guide 102. The circular arc portions of photosensitive-drum supporting members at both ends of the drum cartridge 41 abut (come into contact with) inverse V-shape portions, which are positioning portions 31 of a front frame 3 and a rear frame (not illustrated), so that the cartridge 41 is positioned in the image forming apparatus 1. This also applies to the developing cartridge 42. The developing cartridge 42 is urged upward in the image forming apparatus 1 by the cartridge pressing member 106 disposed in the lower guide 102, and the positing portions at both ends of the developing cartridge 42 are positioned to inverse V-shape portions, which are positioning portions of the front frame 3 and the rear frame.

Next, the motions of the cartridge peripheral components in a state in which the cover 100 is opened (the cartridge can be mounted or demounted) will be described. When the cover 100 is opened or closed, a lever 105 is rotated by a predetermined amount in the order of an inner cover 101 (FIG. 3B) and the lever 105 (FIGS. 4A and 4B). The lever 105 is connected to a rotation axis 107 serving as a rotation fulcrum, an arm 108, and the lower guide 102. The lower guide 102 rotates downward in the direction of gravity in the apparatus main body in conjunction with the opening of the cover 100. The downward movement of the lower guide 102 releases the biasing of the cartridges 41 and 42 from the inverse V-shape portions of the front frame 3 and the rear frame. By moving the lower guide 102 up and down in conjunction with the opening and closing of the cover, an operating force for mounting and demounting the cartridges 41 and 42 to/from the apparatus main body can be reduced.

As illustrated in FIGS. 5A and 5B, the lower guide 102 has recesses so as to guide the lower surface and the side of each cartridge. The cartridges 41 and 42 are mounted or demounted, with the recesses engaged with protrusions on the lower surfaces at the longitudinal ends of the drum cartridge 41 and the developing cartridge 42. The upper guide 103 has recesses so as to guide the upper surfaces and sides of the cartridges 41 and 43. The cartridges 41 and 42 are mounted or demounted, with the recesses engaged with or disengaged from protrusions on the upper surfaces at the longitudinal ends of the drum cartridge 41 and the developing cartridge 42. As the top and bottom of each cartridge are guided by the cartridge guides, the user can demount a cartridge from the main body only by putting the user's hand on the handle at the front of the cartridge for replacement of the cartridge. Also when mounting a cartridge, the user can mount the cartridge to the main body only by pushing the cartridge after inserting one longitudinal end of the cartridge into a predetermined guide port.

The pre-exposure unit 104 that emits light toward the photosensitive drum 43 is integrated with a side of the upper guide 103. The pre-exposure unit 104 needs to be disposed close to the photosensitive drum 43 because the surface of the photosensitive drum 43 needs to be accurately irradiated with LED light. Since the pre-exposure unit 104 is integrated with the upper guide 103, the distance between the photosensitive drum 43 and the pre-exposure unit 104 positioned by the upper guide 103 can be accurately provided.

Figure 8A:
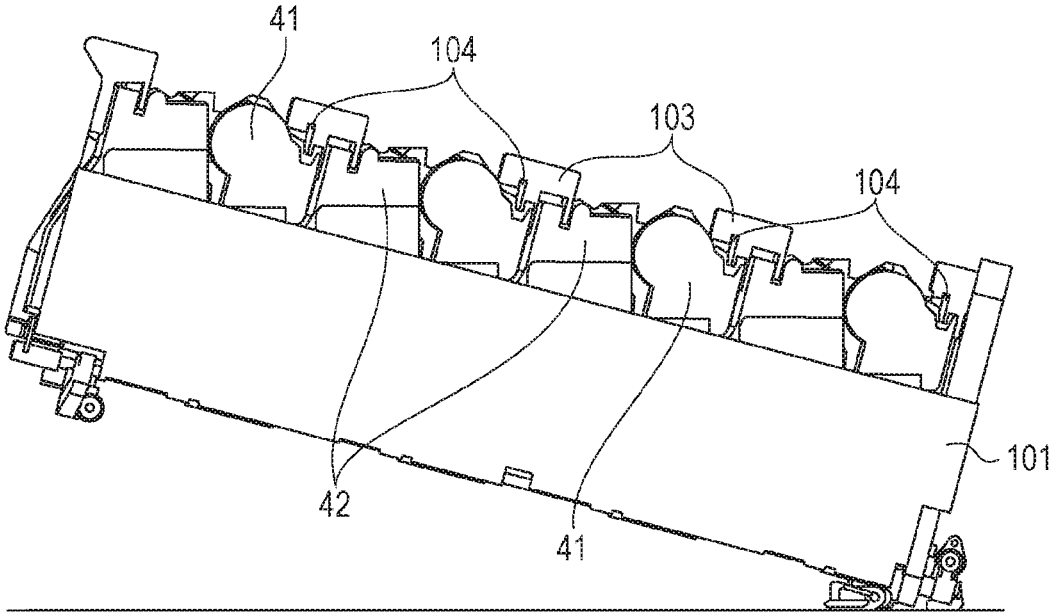
FIG. 8A is a diagram illustrating the state of the cartridges, with an inner cover closed.
Figure 8B:
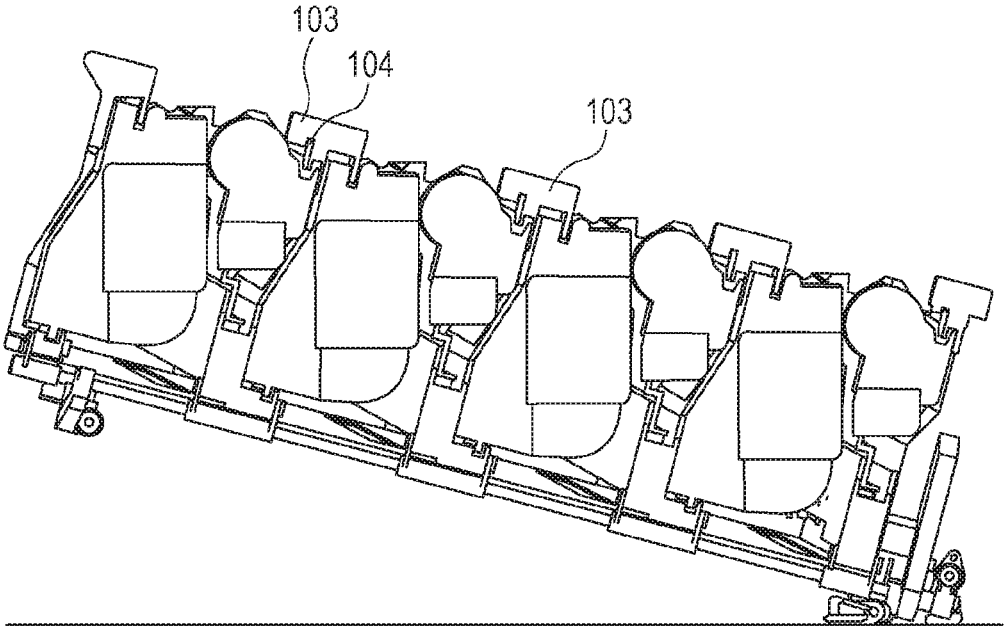
FIG. 8B is a diagram illustrating the state of the cartridges, with the inner cover removed.
Figure 9:
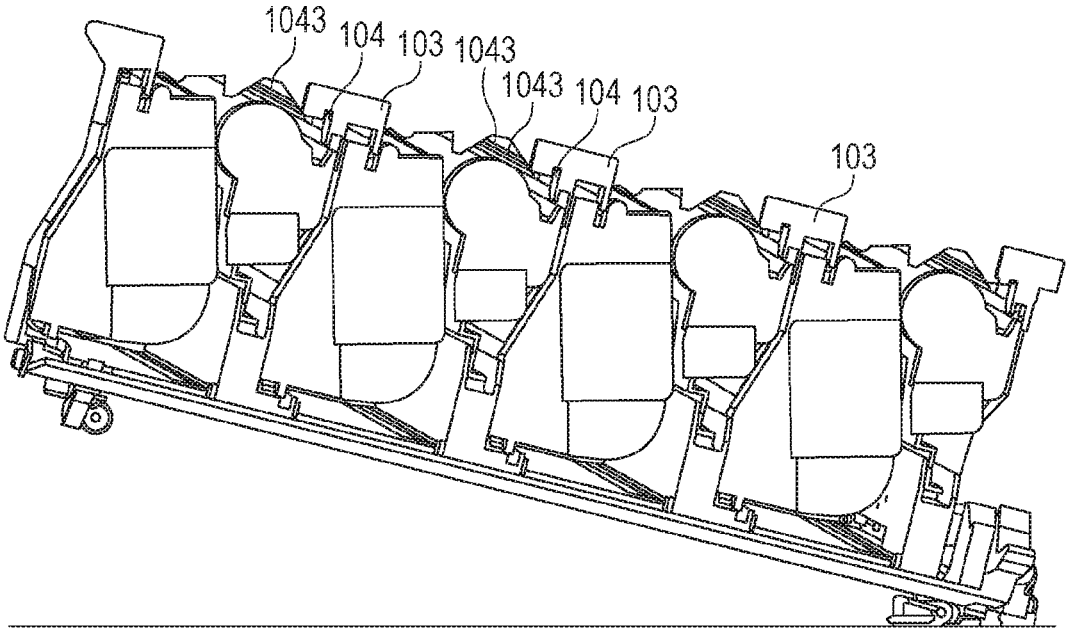
FIG. 9 is a diagram illustrating the state of the cartridges, with the inner cover opened.

Referring to FIGS. 8A and 8B and FIG. 9, the configuration of the cartridges 41 and 42 and their peripherals will be further described. FIGS. 8A and 8B illustrate a state in which the exterior cover 100 is closed. The inner cover 101 is disposed inside the exterior cover 100. FIG. 8A is a diagram illustrating a state in which the exterior cover 100 is removed. Part of the cartridges 41 and 42 are covered with the inner cover 101. FIG. 8B illustrates a state in which the inner cover 101 is removed. As illustrated in FIG. 8B, the drum cartridges 41 are pushed up with the lower guides 102 at the apparatus main body into engagement with the positioning portions 31 of the front frame 3 and the rear frame at the main body, thus being positioned in the image forming apparatus 1. Therefore, the lens units 1043 of the pre-exposure units 104 cannot be viewed in the perspective views in FIGS. 8A and 8B.

FIG. 9 is a perspective view of the image forming apparatus 1 in which the exterior cover 100 and the inner cover 101 are opened. In the present embodiment, each lower guide 102 serving as a guide moves downward in the direction of gravity in conjunction with the opening or closing of the cover 100, so that the distance between the pre-exposure unit 104 and the drum cartridge 41 (or the photosensitive drum 43) in the direction perpendicular to the longitudinal direction of the drum cartridge 41 increases. With the distance between the pre-exposure unit 104 and the drum cartridge 41 increased, a plurality of lens units 1043 of each pre-exposure unit 104 can be viewed as illustrated in FIG. 9. Since the light emitted from the LEDs 1041 passes through the lens units 1043, the fact that a large number of lens units 1043 can be viewed allows the user to more easily recognize the light than in FIGS. 8A and 8B, thus increasing the user's visibility.

[Method for Notifying User]

For example, when it is detected that the operating time of components in a cartridge is equal to or longer than a predetermined time from the history of paper passage of the image forming apparatus 1, the controller (the control unit 11) notifies the user of it by displaying an instruction to replace the cartridge on the display 2. When it is detected that the amount of toner remaining in the developing cartridge 42 becomes less than or equal to a predetermined amount, the control unit 11 notifies the user of it by displaying an instruction to replace the developing cartridge 42 on the display 2. The user provides a new cartridge based on the notification and replaces the developing cartridge 42. In the present embodiment, the control unit 11 displays a cartridge replace instruction on the display 2. In addition, the control unit 11 causes a pre-exposure unit 104 that is a light emitting unit closest to the cartridge to be removed to emit light (turn on light), thereby improving user's visibility to enhance the usability. In the present embodiment, the control unit 11 causes a light emitting unit closest to the cartridge to emit light on a surface perpendicular to the longitudinal direction of the cartridge (for the drum cartridge 41, a surface perpendicular to the axial direction of the photosensitive drum 41).

For example, when the user replaces a cartridge, the cover 100 is opened according to an instruction on the display 2. When any of the drum cartridges 41 is to be replaced, the control unit 11 specifies the drum cartridge 41 to be replaced on the display 2 and causes a pre-exposure unit 104 closest to the drum cartridge 41 to light (emit light). When the cover 100 is opened, as illustrated in FIGS. 5B and 6B, the lower guide 102 is at the lower position, so that the drum cartridge 41 is positioned lower than the image forming position, so that the clearance between the pre-exposure unit 104 and the photosensitive drum 43 is increased. In other words, the photosensitive drum 43 (the image bearing member) is disposed at a position more distant from the pre-exposure unit 104 (a light emitting unit) in the direction perpendicular to the longitudinal direction of the drum cartridge 41 in a state in which the cover 100 is opened than a closed state. The space formed between the drum cartridge 41 and the positioning portion 31 of the frame for positioning the drum cartridge 41 is larger in the cover opened state than the cover closed state viewed from a plane perpendicular to the longitudinal direction of the drum cartridge 41.

Each pre-exposure unit 104 includes a plurality of LEDs 1041. The LEDs 1041 are disposed at intervals along the surface of the photosensitive drum 43 in the longitudinal direction of the photosensitive drum 43. For that reason, even a LED closest to the front of the apparatus (at the front of the apparatus) is disposed nearer to the longitudinal center of the photosensitive drum 43 than the ends, not at the front end of the drum cartridge 41. Therefore, in the case where the pre-exposure unit 104 and the photosensitive drum 43 are positioned for image formation, the optical path through which the light propagates to the front of the apparatus main body (the front) is narrow as illustrated in FIG. 6A. This makes it difficult for the user at the front of the apparatus to view the light emitted from the LED 1041 of the pre-exposure unit 104. By lowering the drum cartridge 41 to increase the clearance between the pre-exposure unit 104 and the drum cartridge 41, as illustrated in FIG. 6B, the optical path from the LED 1041 of the pre-exposure unit 104 to the front of the apparatus main body increases. This allows the user to recognize the light emitted from the LED 1041 of the pre-exposure unit 104 from the front of the apparatus main body.

Thus, the user can recognize the cartridge to be replaced more easily than the case of determination based only on the label on the apparatus main body or the cartridge and the information on the display 2. This allows a predetermined cartridge to be easily distinguished from four sets of the drum cartridge 41 and the developing cartridge 42 for each color, totaling eight cartridges.

Also in mounting a new cartridge, lighting a pre-exposure unit 104 closest to the mount position allows the user to easily recognize the mount position to facilitate guiding.

In the present embodiment, the clearance between the pre-exposure unit 104 and the drum cartridge 41 is uniformly increased in the longitudinal direction by moving the lower guide 102. However, this is given merely for illustrative purposes. The similar effect can be given also by a configuration in which the clearance between the pre-exposure unit 104 and the drum cartridge 41 increases only at the front of the apparatus main body. When viewed from a plane perpendicular to the longitudinal direction of the drum cartridge 41, the distance between the photosensitive drum 43 (the image bearing member) and the pre-exposure unit (the light emitting unit) is preferably 3 mm or more longer in the state in which the cover is opened than the state in which the cover 100 is closed. This is because the large distance in the cover opened state allows the user to more easily view the light from the light emitting unit. The distance between the photosensitive drum 43 (the image bearing member) and the pre-exposure unit 104 in the cover opened state is preferably longer than that in the cover closed state in the range of 3 mm or more and 6 mm or less. With such a distance, user's visibility can be improved without increasing the number of components while maintaining the size of the image forming apparatus 1.

[Second Embodiment]

Next, a second embodiment will be described. Since the overall configuration of the image forming apparatus 1 and the peripheral configuration of the cartridges are the same as those of the first embodiment, descriptions thereof will be omitted. The second embodiment is the same as the first embodiment in that it is configured to demount and mount the cartridges to the apparatus front side in the longitudinal direction of the cartridges (the axial direction of the photosensitive drum 43) for cartridge replacement (side-oriented configuration). The second embodiment is the same as the first embodiment in that it is configured to demount and mount the cartridges by opening and closing the rotatable cover 100 at the front of the apparatus 1 and that the upper guide 103 and the lower guide 102 serving as guides are provided. However, the lower guide 102 serving as a guide does not move in conjunction with the opening and closing of the cover 100, so that the cartridges do not move up and down according to the opening and closing of the cover 100.

The first embodiment is configured such that the lower guide 102 moves down when the cover 100 is opened, so that the clearance between the drum cartridge 41 and the pre-exposure unit 104 is increased to allow the LED light from the pre-exposure unit 104 to be viewed by the user, thereby making the user notified of replacement of the cartridge. In the second embodiment, the pre-exposure unit 110 is moved in conjunction with the opening or closing of the cover 100 to notify the user of the drum cartridge 41 to be replaced.

Figure 7A:
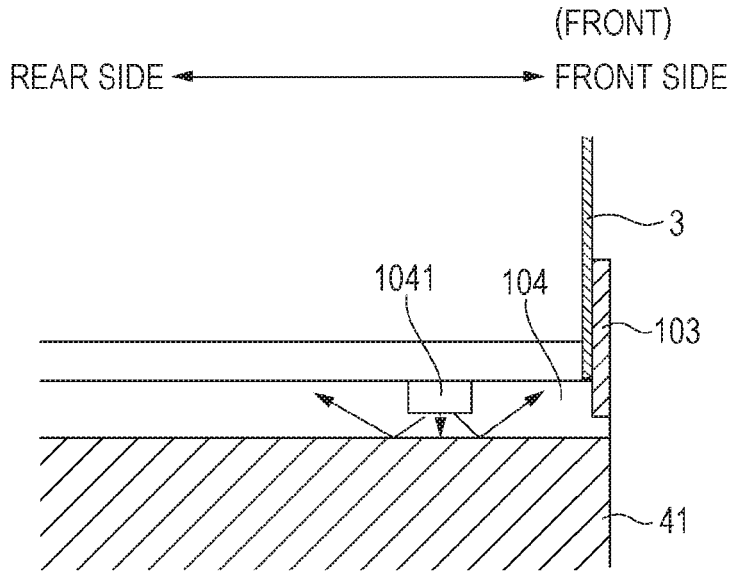
FIG. 7A is a diagram illustrating the state of light emitted from a pre-exposure unit (a light emitting unit) when the cover is closed according to a second embodiment of the present disclosure.
Figure 7B:
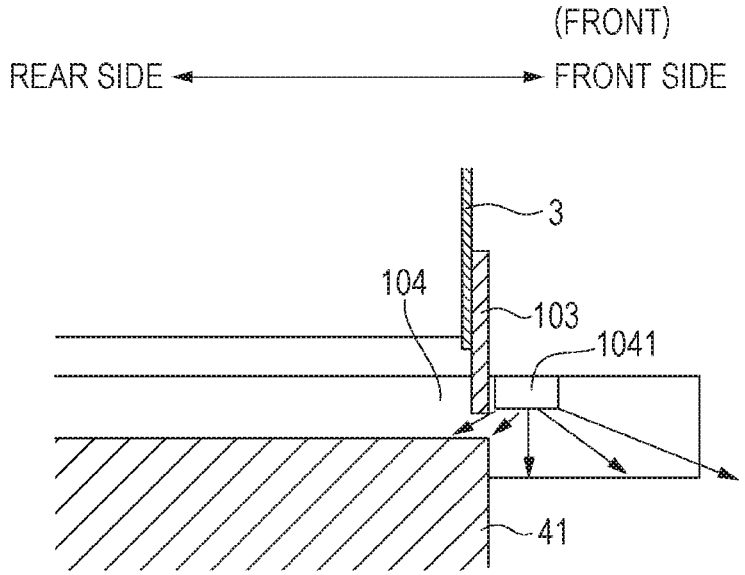
FIG. 7B is a diagram illustrating the state of light emitted from the pre-exposure unit when the cover is opened according to the second embodiment.

FIGS. 7A and 7B are diagrams illustrating the positional relationship between the pre-exposure unit 110 and the drum cartridge 41 when the cover 100 is closed and opened, respectively. FIG. 7A illustrates a disposition when the cover 100 is closed for image formation. FIG. 7B illustrates a disposition when the cover 100 is opened to replace a cartridge or mount or demount a cartridge. The pre-exposure unit 104 is attached to the upper guide 103 serving as a guide fixed to the front frame 3 and is configured to be slidable parallel to the axis of the photosensitive drum 43. In other words, the pre-exposure unit 104 is configured to be movable toward an opening that is formed when the cover 100 is opened. The pre-exposure unit 104 (light emitting unit) is urged toward the opening at the front of the apparatus main body by a pre-exposure unit urging member (not illustrated). When the cover 100 is closed, the pre-exposure unit 104 is pushed toward the back of the apparatus main body by the cover 100 into an image forming position. When the cover 100 is opened, the pressure of the cover 100 is released, and the pre-exposure unit 104 urged by the pre-exposure unit urging member slides toward the front of the apparatus main body, so that part of the plurality of LEDs 1041 of the pre-exposure unit 110 are exposed to the front of the apparatus main body.

When the user replaces a cartridge, the cover 100 is opened according to an instruction on the display 2. When any of the drum cartridges 41 is to be replaced, the control unit 11 transmits a signal for displaying the drum cartridges 41 to be replaced on the display 2 and controls a pre-exposure unit 104 closest to the drum cartridge 41 so that it is lit. Since part of the LEDs 1041 on the pre-exposure unit 104 is exposed from the apparatus main body when the cover 100 is opened, the user can directly view the light of the lit LEDs 1041, so that the drum cartridge 41 to be replaced can easily be distinguished.

Even in mounting a new cartridge, the control unit 11 performs control to turn on (light) a pre-exposure unit 104 closest to the mount position so as to guide the user for mounting.

[Third Embodiment]

In the first and second embodiments, the case of eight cartridges has been described. This is given merely for illustrative purposes. Any image forming apparatus may be employed in which cartridges can be removably mounted from the longitudinal direction of the cartridges, and at least two cartridges can be held. In the third embodiment, an image forming apparatus including four cartridges from a first cartridge to a fourth cartridge each of which can be independently mounted and demounted. The first cartridge includes a first image bearing member. The second cartridge includes a second image bearing member. The third cartridge contains toner and supplies toner for forming a toner image on the first image bearing member. The fourth cartridge contains toner and supplies toner for forming a toner image on the second image bearing member. The image forming apparatus includes a first light emitting unit that emits light toward the first image bearing member, a second light emitting unit that emits light toward the second image bearing member, and a control unit 11 for controlling the light emission of the first light emitting unit and the second light emitting unit.

The control unit performs control to emit light from the first light emitting unit when determining that it is necessary to demount the first cartridge from the image forming apparatus, with the cover opened. When the control unit determines that it is necessary to demount the third cartridge from the image forming apparatus with the cover opened, the control unit controls the first light emitting unit so that the first light emitting unit emits light. Thus, when it is necessary to demount the first cartridge, and also when it is necessary to demount the third cartridge, the first light emitting unit emits light. When it is necessary to demount the first cartridge, the first light emitting unit may be turned on, and when it is necessary to demount the third cartridge, the third light emitting unit may be blinked so that the visibility of the cartridge to be demounted is increased.

[Other Embodiments]

The first embodiment is configured to notify the user that the cartridge is to be replaced by changing the position of the drum cartridge 41. The second embodiment is configured to notify the user that the cartridge is to be replaced by changing the position of the pre-exposure unit 104. However, the present disclosure is not limited to the above configurations. Another method may be employed to enable the LED light of the pre-exposure unit 104 to be viewed by moving the cartridge or the pre-exposure unit 104 in accordance with the opening and closing of the cover 100.

Although the first and second embodiments are configured to make the pre-exposure unit 104 luminous only when the drum cartridge 41 is to be replaced, the pre-exposure unit 104 may be made luminous when the developing cartridge 42 is to be replaced. Furthermore, the control unit may execute different light emission methods among the case where the cartridge to be replaces is the drum cartridge 41, the developing cartridge 42, and both of them. For example, when the drum cartridge 41 is to be replaced, the light emitting unit is lit, and when the developing cartridge 42 is to be replaced, the light emitting unit is blinked.

Although the first and second embodiments have been described on the assumption that a cartridge is replaced by demounting and mounting the cartridge, this is given merely for illustrative purposes. In addition to replacing the cartridge, when the control unit determines that it is necessary to demount the cartridge, the pre-exposure unit (the light emitting unit) may be lit. When a specific cartridge needs to be demounted, for example, at a paper jam, that fact may be displayed on the display, and a pre-exposure unit closest to the specific cartridge may be lit to enhance the usability.

Although the first and second embodiments are configured such that light is emitted from the LED of the pre-exposure unit 104, with the cover opened, the light emitting unit may not necessarily be the pre-exposure unit 104 but may be an exposure unit for image formation. The use of the existing light emitting unit suppresses an increase in the number of components. The pre-exposure unit 104 is preferable because user's visibility is increased with movement of a small number of components.

In the first and second embodiments, the control unit 11 controls the light emission of the light emitting unit. The control unit 11 may also control an image forming process for forming an image on a printing material.

According to the embodiments of the present disclosure, user's visibility for a cartridge to be demounted is increased, so that usability can be enhanced in a configuration in which cartridges are removably mounted from the longitudinal direction of the cartridges (a side-oriented configuration).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-183526, filed Sep. 25, 2017, which is hereby incorporated by reference herein in its entirety.

The invention claimed is:

1. An image forming apparatus capable of holding at least two cartridges, wherein the cartridges can be mounted on or demounted from the image forming apparatus in a longitudinal direction of the cartridges, the apparatus comprising:

a light emitting unit configured to emit light toward an image bearing member;

a control unit configured to control light emission of the light emitting unit; and a cover configured to be opened to mount or demount the cartridge, wherein the image bearing member is disposed at a first position farther from the light emitting unit in a state in which the cover is opened than at a second position in a state in which the cover is closed in a direction perpendicular to a longitudinal direction of the cartridge, and wherein the control unit controls the light emission of a light emitting unit closest to a cartridge that is determined to be removed from the image forming apparatus.

2. The image forming apparatus according to claim 1, further comprising:

an exposure unit configured to expose the image bearing member to light to form an electrostatic latent image on the image bearing member; and a developing unit configured to develop the electrostatic latent image to form a toner image on the image bearing member, wherein the light emitting unit comprises a pre-exposure unit configured to expose a surface of the image bearing member to light after the toner image on the image bearing member is transferred.

3. The image forming apparatus according to claim 1, further comprising:

a positioning unit configured to position the cartridge in the image forming apparatus, wherein, when the cover is closed, the cartridge comes into contact with the positioning unit so that the cartridge is positioned, wherein, when the cover is opened, the cartridge is separated from the positioning unit, and wherein, when viewed from a plane perpendicular to the longitudinal direction of the cartridge, a space formed between the cartridge and the positioning unit is wider in the state in which the cover is opened than in the state in which the cover is closed.

4. The image forming apparatus according to claim 1, further comprising:

a guide configured to guide the cartridge to mount the cartridge to the image forming apparatus, wherein the guide moves downward in a direction of gravity in the image forming apparatus as the cover is opened.

5. The image forming apparatus according to claim 1, wherein, in the direction perpendicular to the longitudinal direction of the cartridge, a distance between the image bearing member and the light emitting unit in the state in which the cover is opened is 3 mm or more longer than a distance between the image bearing member and the light emitting unit in the state in which the cover is closed.

6. The image forming apparatus according to claim 1, wherein the light emitting unit includes a plurality of light-emitting diodes (LEDs) and a plurality of lens units that transmit light emitted from the LEDs, wherein the plurality of LEDs are disposed at intervals in the longitudinal direction of the cartridge.

7. The image forming apparatus according to claim 1, wherein, when the image bearing member is a first image bearing member, at least two cartridges comprise a first cartridge including the first image bearing member and a second cartridge including the second image bearing member.

8. An image forming apparatus capable of holding at least two cartridges, wherein the cartridges can be mounted on or demounted from the image forming apparatus in a longitudinal direction of the cartridges, the apparatus comprising:

a light emitting unit configured to emit light toward an image bearing member;

a control unit configured to control light emission of the light emitting unit; and a cover configured to be opened or closed to mount or demount the cartridge, wherein, when the cover is opened, the light emitting unit moves toward an opening formed when the cover is opened, and wherein the control unit controls the light emission of a light emitting unit closest to a cartridge that is determined to be removed from the image forming apparatus.

9. The image forming apparatus according to claim 8, further comprising:

an exposure unit configured to expose the image bearing member to light to form an electrostatic latent image on the image bearing member; and a developing unit configured to develop the electrostatic latent image to form a toner image on the image bearing member, wherein the light emitting unit comprises a pre-exposure unit configured to expose a surface of the image bearing member to light after the toner image on the image bearing member is transferred.

10. An image forming apparatus in which a first cartridge including a first image bearing member, a second cartridge including a second image bearing member, a third cartridge that contains toner and is configured to supply toner to the first image bearing member to form a toner image, and a fourth cartridge that contains toner and is configured to supply toner to the second image bearing member to form a toner image are independently removably mounted in a longitudinal direction of each cartridge, the apparatus comprising:

a first light emitting unit configured to emit light toward the first image bearing member;

a second light emitting unit configured to emit light toward the second image bearing member;

a control unit configured to control light emission of the first light emitting unit and the second light emitting unit; and a cover configured to be opened or closed to mount or demount the first to four cartridges, wherein the first image bearing member is disposed at a first position farther from the first light emitting unit in a state in which the cover is opened than at a second position in a state in which the cover is closed in a direction perpendicular to a longitudinal direction of the cartridge, wherein the second image bearing member is disposed at a third position farther from the second light emitting unit in a state in which the cover is opened than at a fourth position in a state in which the cover is closed in the direction perpendicular to the longitudinal direction of the cartridge, and wherein, when the control unit determines that the first cartridge needs to be demounted from the image forming apparatus, the control unit controls light emission so that light is emitted from the first light emitting unit in the state in which the cover is opened.

11. An image forming apparatus in which a first cartridge including a first image bearing member, a second cartridge including a second image bearing member, a third cartridge that contains toner and is configured to supply toner to the first image bearing member to form a toner image, and a fourth cartridge that contains toner and is configured to supply toner to the second image bearing member to form a toner image are independently removably mounted in a longitudinal direction of each cartridge, the apparatus comprising:

a first light emitting unit configured to emit light toward the first image bearing member;

a second light emitting unit configured to emit light toward the second image bearing member;

a control unit configured to control light emission of the first light emitting unit and the second light emitting unit; and a cover configured to be opened or closed to mount or demount the first to four cartridges, wherein the first image bearing member is disposed at a first position farther from the first light emitting unit in a state in which the cover is opened than at a second position in a state in which the cover is closed in a direction perpendicular to a longitudinal direction of the cartridge, wherein the second image bearing member is disposed at a third position farther from the second light emitting unit in a state in which the cover is opened than at a fourth position in a state in which the cover is closed in the direction perpendicular to the longitudinal direction of the cartridge, and wherein, when the control unit determines that the third cartridge needs to be demounted from the image forming apparatus, the control unit controls light emission so that light is emitted from the first light emitting unit in the state in which the cover is opened.

* * * * *